US008845301B2

(12) United States Patent
Smith

(10) Patent No.: US 8,845,301 B2
(45) Date of Patent: Sep. 30, 2014

(54) COMPRESSOR CONTROL METHOD

(75) Inventor: Mark G. Smith, Canton, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 443 days.

(21) Appl. No.: 13/172,308

(22) Filed: Jun. 29, 2011

(65) Prior Publication Data

US 2013/0004336 A1 Jan. 3, 2013

(51) Int. Cl.
*F04B 49/02* (2006.01)
*F04B 49/06* (2006.01)
*F04B 39/06* (2006.01)

(52) U.S. Cl.
CPC ..... *F04B 49/06* (2013.01); *F04B 39/06* (2013.01)
USPC ..... 417/32; 417/44.1

(58) Field of Classification Search
CPC ... F04B 2203/0205; F04B 49/06; F04B 39/06
USPC ..... 417/32, 44.1, 44.11
See application file for complete search history.

(56) References Cited

U.S. PATENT DOCUMENTS

| | | | | |
|---|---|---|---|---|
| 5,072,597 | A | 12/1991 | Bromley et al. | |
| 5,764,011 | A * | 6/1998 | Nakae et al. | 318/471 |
| 7,201,010 | B2 | 4/2007 | Homan et al. | |
| 2003/0230101 | A1 * | 12/2003 | Iritani et al. | 62/228.3 |
| 2010/0172764 | A1 * | 7/2010 | Nakano et al. | 417/44.11 |

FOREIGN PATENT DOCUMENTS

| | | | | |
|---|---|---|---|---|
| WO | WO0199134 A3 | | 6/2000 | |
| WO | WO2009066483 | * | 5/2009 | F04B 49/10 |

* cited by examiner

*Primary Examiner* — Bryan Lettman
(74) *Attorney, Agent, or Firm* — David Kelley, Esq.; Tung & Associates

(57) ABSTRACT

A compressor control method for prolonging operating time of a vehicle air conditioning compressor. The method includes monitoring an operating temperature of an insulated gate bipolar transistor in the compressor, comparing the operating temperature to at least one predetermined threshold temperature, and continuing operation of the compressor if the operating temperature is below the at least one predetermined threshold temperature. At least one mitigating step is implemented to prevent premature shutdown of the compressor if the operating temperature is above the at least one predetermined threshold temperature.

17 Claims, 1 Drawing Sheet

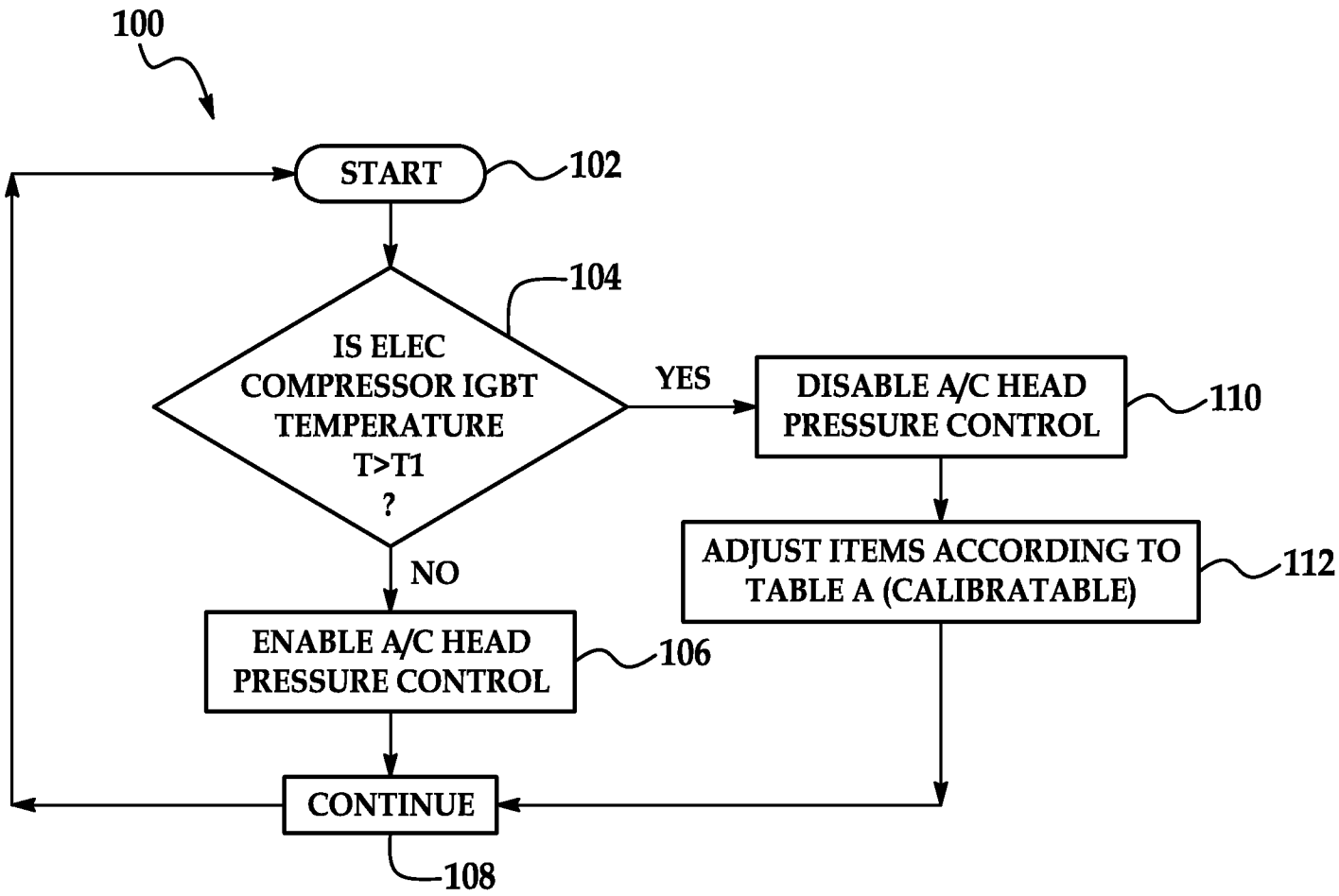
100
START
102
IS ELEC COMPRESSOR IGBT TEMPERATURE T>T1 ?
104
YES
NO
DISABLE A/C HEAD PRESSURE CONTROL
110
ADJUST ITEMS ACCORDING TO TABLE A (CALIBRATABLE)
112
ENABLE A/C HEAD PRESSURE CONTROL
106
CONTINUE
108

COMPRESSOR CONTROL METHOD

FIELD

The disclosure generally relates to methods of controlling vehicle air conditioner compressors. More particularly, the disclosure relates to a compressor control method which prolongs operation of a vehicle air conditioner compressor while preventing overheating of Insulated Gate Bipolar Transistors (IGBTs) in the compressor.

BACKGROUND

Conventional air conditioner compressors in hybrid electric vehicles (HEVs) may include insulated gate bipolar transistors (IGBTs) which are three-terminal power semiconductor devices that switch electric power among electrical components. The IGBTs may be cooled inside the compressor by flowing a suction gas over a heat sink area or by operation of a cooling plate in the compressor.

Under some circumstances (such as when the fan motor of the a/c unit is not working optimally, for example), the head pressure of refrigerant leaving the compressor may rise and the IGBTs in the compressor may have a tendency to overheat. The existing compressor controls may be set to terminate operation of the compressor at a predetermined operating head pressure limit (such as 400 psia, for example) under the assumption that the operating temperature of the IGBTs may be excessively high at that pressure. However, in many situations, the operating temperature of the IGBTs in the compressor may actually be within the acceptable temperature range even though the measured head pressure may be equal to or greater than the operating head pressure limit at which operation of the compressor is terminated. Thus, the operating head pressure limit at which operation of the compressor is terminated may be lower than the hardware head pressure limit; therefore, terminating operation of the compressor at the operating head pressure limit may result in premature shutdown of the vehicle air conditioner in many cases.

Accordingly, a compressor control method which prolongs operation of a vehicle air conditioner compressor while preventing overheating of Insulated Gate Bipolar Transistors (IGBTs) in the compressor is needed.

SUMMARY

The disclosure is generally directed to a compressor control method for prolonging operating time of a vehicle air conditioning compressor. An illustrative embodiment of the method includes monitoring an operating temperature of an insulated gate bipolar transistor in the compressor, comparing the operating temperature to at least one predetermined threshold temperature, continuing operation of the compressor if the operating temperature is below the at least one predetermined threshold temperature and implementing at least one mitigating step to prevent premature shutdown of the compressor if the operating temperature is above the at least one predetermined threshold temperature.

In some embodiments, the compressor control method may include monitoring an operating temperature of an insulated gate bipolar transistor in a compressor; comparing the operating temperature to at least one of a plurality of predetermined threshold temperatures of increasing magnitude; continuing operation of the compressor if the operating temperature is below the plurality of predetermined threshold temperatures; and implementing at least one of a plurality of sets of mitigating steps to prevent premature shutdown of the compressor if the operating temperature is above the plurality of predetermined threshold temperatures, respectively.

In some embodiments, the compressor control method may include monitoring an operating temperature of an insulated gate bipolar transistor in a compressor; comparing the operating temperature to at least one of a first predetermined threshold temperature, a second predetermined threshold temperature, a third predetermined threshold temperature and a predetermined termination threshold temperature of increasing magnitude; continuing operation of the compressor if the operating temperature is below the first predetermined threshold temperature; implementing at least one of a plurality of sets of mitigating steps to prevent premature shutdown of the compressor if the operating temperature is above at least one of the first predetermined threshold temperature, the second predetermined threshold temperature and the third predetermined threshold temperature, respectively; and terminating operation of the compressor if the operating temperature is above the predetermined termination threshold temperature.

BRIEF DESCRIPTION OF THE DRAWINGS

The disclosure will now be made, by way of example, with reference to the accompanying drawings, in which:

FIG. 1 is a flow diagram which illustrates an illustrative embodiment of the compressor control method.

DETAILED DESCRIPTION

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to implement the disclosure and are not intended to limit the scope of the claims. Furthermore, there is no intention to be bound by any expressed or implied theory presented in the preceding technical field, background, brief summary or the following detailed description.

The disclosure is generally directed to a compressor control method which prolongs operation of a vehicle air conditioner compressor while preventing overheating of Insulated Gate Bipolar Transistors (IGBTs) in the compressor. The method may include monitoring an operating temperature of an insulated gate bipolar transistor in the compressor; comparing the monitored operating temperature to at least one predetermined threshold temperature; continuing operation of the compressor if the monitored operating temperature is below the predetermined threshold temperature or temperatures; and implementing mitigating steps to prevent premature shutdown of the compressor if the monitored operating temperature is above the predetermined threshold temperature or temperatures. Accordingly, the method may facilitate operation of the compressor at rising a/c head pressures under circumstances in which the operating temperature of the IGBTs remains within an acceptable range. The PCM (Powertrain Control Module) of the vehicle controls operation of the compressor and may be programmed to implement the method according to the knowledge of those skilled in the art.

In some embodiments, implementing mitigating steps to prevent premature shutdown of the compressor may include disabling head pressure control of the compressor. In some embodiments, implementing mitigating steps to prevent premature shutdown of the compressor may include adjusting at least one of an air intake door position, an engine cooling fan speed, a grill shutter position, a blower speed and a compressor rpm.

In some embodiments, comparing the monitored operating temperature to at least one predetermined threshold temperature may include comparing the monitored operating temperature to a first predetermined threshold temperature; implementing a first set of mitigating steps in the event that the monitored operating temperature exceeds the first predetermined threshold temperature; comparing the monitored operating temperature to a second predetermined threshold temperature; and implementing a second set of mitigating steps in the event that the monitored operating temperature exceeds the second predetermined threshold temperature.

In some embodiments, comparing the monitored operating temperature to at least one predetermined threshold temperature may include comparing the monitored operating temperature to a third predetermined threshold temperature and implementing a third set of mitigating steps in the event that the monitored operating temperature exceeds the third predetermined threshold temperature.

In some embodiments, comparing the monitored operating temperature to at least one predetermined threshold temperature may include comparing the monitored operating temperature to a predetermined termination threshold temperature and terminating operation of the compressor in the event that the monitored operating temperature exceeds the predetermined termination threshold temperature.

Referring to FIG. 1, a flow diagram 100 which illustrates an illustrative embodiment of the compressor control method is shown. In some applications, the compressor control method may be implemented in air conditioning units of hybrid electric vehicles (HEVs). In other applications, the compressor control method may be implemented in the air conditioning units of other types of vehicles or may be adapted to non-vehicle applications. At block 102, the operating temperature of at least one IGBT (Insulated Gate Bipolar Transistor) in the a/c compressor may be continually or periodically monitored. At block 104, the monitored operating temperature (T) of the IGBT may be compared to at least one predetermined threshold temperature (T1). In the event that the monitored operating temperature (T) of the IGBT does not exceed the predetermined threshold temperature (T1), the a/c head pressure control is enabled (block 106). At block 108, the method continues to block 102 in which the operating temperature of the IGBT is continually or periodically monitored.

In the event that the monitored operating temperature (T) of the IGBT exceeds the predetermined threshold temperature (T1) at block 104, the a/c head pressure control is disabled at block 110. At block 112, mitigating steps are taken to prevent operation of the compressor from being terminated prematurely even though the monitored operating temperature (T) exceeds the predetermined threshold temperature (T1). The mitigating steps which are taken may include adjustment of various parameters that optimize temperature and operation of the compressor. For example and without limitation, the mitigating steps which are taken at block 112 may include adjustment of an air intake door position; adjustment of an engine cooling fan; adjustment of front end cooling module grill shutters; adjustment of a blower speed; and/or adjustment of compressor rpm. A final mitigation step may include terminating operation of the compressor.

In some embodiments, the method 100 may include comparing the monitored operating temperature (T) to a second predetermined threshold temperature (T2) greater than the first predetermined threshold temperature (T1) at block 104; disabling the a/c head pressure control at block 110 in the event that the monitored operating temperature (T) exceeds the second predetermined threshold temperature (T2); implementing a second set of the mitigating steps at block 112; continuing the method at block 108; and monitoring the operating temperature of the IGBT at block 102.

In some embodiments, the method 100 may include comparing the monitored operating temperature (T) to a third predetermined threshold temperature (T3) greater than the second predetermined threshold temperature (T2) at block 104; disabling the a/c head pressure control (block 110) in the event that the monitored operating temperature (T) exceeds the third predetermined threshold temperature (T3); implementing a third set of the mitigating steps at block 112; continuing the method at block 108; and monitoring the operating temperature of the IGBT at block 102.

In some embodiments, the method may include comparing the monitored operating temperature (T) to any one of subsequent predetermined threshold temperatures (Ts) higher than the third predetermined threshold temperature (T3) at block 104; disabling the a/c head pressure control (block 110) in the event that the monitored operating temperature (T) exceeds any of the subsequent predetermined threshold temperatures (Ts); implementing subsequent sets of the mitigating steps at block 112; continuing the method at block 108; and monitoring the operating temperature of the IGBT at block 102.

In some embodiments, the method 100 may include comparing the monitored operating temperature (T) to a predetermined termination threshold temperature (Tt) at block 112; disabling the a/c head pressure control (block 110) in the event that the monitored operating temperature (T) exceeds the predetermined termination threshold temperature (Tt); terminating operation of the compressor at block 112; continuing the method at block 108; and monitoring the operating temperature of the IGBT at block 102.

In some embodiments, the mitigating steps which are taken in the event that the monitored operating temperature (T) exceeds the respective predetermined threshold temperatures (T1, T2, T3, Tt) may be implemented according to Table (A) below:

TABLE A

| | IGBT Temperature | | | | | |
|---|---|---|---|---|---|---|
| | IGBT Temperature | T < T1 | T1 < T < T2 | T2 < T < T3 | T3 < T < Tt | T1 > Tt |
| OUTPUT CONTROLS | Air intake door position | No change | Go to recirc | Recirc | Recirc | Output |

TABLE A-continued

| IGBT Temperature | | | | | |
|---|---|---|---|---|---|
| IGBT Temperature | T < T1 | T1 < T < T2 | T2 < T < T3 | T3 < T < Tt | T1 > Tt |
| Engine cooling fan | No change | Go to 100% | Go to 100% | Go to 100% open | Go to 100% open |
| Grill shutters | No change | Go to 100% open | Go to 100% open | Go to 100% open | Go to 100% open |
| Blower speed | No change | 85% of max speed | 70% | 70% | Output |
| Compressor RPM | No change | Steps towards best IGBT cooling speed | Best cooling speed | OFF | OFF |

The disclosure is further generally directed to a head pressure speed control method which prolongs operation of a vehicle air conditioner compressor while preventing overheating of Insulated Gate Bipolar Transistors (IGBTs) in the compressor. According to the method, the compressor speed is limited to maintain the refrigerant discharge (head) pressure below a specified value. If the head pressure exceeds the specified value, the compressor rpm is decreased to the point at which the head pressure is at or just below the value (within a dead band). The conditions may indicate that the compressor speed is below the desired speed for the requested cooling load. Condenser outlet refrigerant pressure may also be used to control head pressure in place of the compressor discharge refrigerant pressure.

Although the embodiments of this disclosure have been described with respect to certain exemplary embodiments, it is to be understood that the specific embodiments are for purposes of illustration and not limitation, as other variations will occur to those of skill in the art.

What is claimed is:

1. A compressor control method for prolonging operating time of a vehicle air conditioning compressor, comprising:

monitoring an operating temperature of an insulated gate bipolar transistor in the compressor;

comparing the operating temperature to at least one predetermined threshold temperature;

continuing operation of the compressor if the operating temperature is below the at least one predetermined threshold temperature; and enabling head pressure control of the compressor if the operating temperature is above the at least one predetermined threshold temperature.

2. The method of claim 1 further comprising disabling head pressure speed control of the compressor if the operating temperature is above the at least one predetermined threshold temperature.

3. The method of claim 1 wherein the step of implementing at least one mitigating step comprises adjusting at least one of an air intake door position, an engine cooling fan speed, a grill shutter position, a blower speed, and a compressor rpm.

4. The method of claim 3 wherein adjusting the engine cooling fan speed comprises operating the engine cooling fan speed at 100% capacity or increased speed.

5. The method of claim 3 wherein adjusting the grill shutter position comprises adjusting the grill shutter position to 100% open position or increased % open position.

6. The method of claim 1 wherein the step of implementing at least one mitigating step comprises terminating operation of the compressor.

7. The method of claim 1 wherein the step of comparing the operating temperature to the at least one predetermined threshold temperature comprises comparing the operating temperature to at least one of a plurality of predetermined threshold temperatures.

8. A compressor control method for prolonging operating time of a vehicle air conditioning compressor, comprising:

monitoring an operating temperature of an insulated gate bipolar transistor in the compressor;

comparing the operating temperature to at least one of a plurality of predetermined threshold temperatures of sequentially increasing magnitude;

continuing operation of the compressor if the operating temperature is below the at least one of a plurality of predetermined threshold temperatures; and disabling head pressure control of the compressor if the operating temperature is above the at least one of a plurality of predetermined threshold temperatures, respectively.

9. The method of claim 8 wherein the step of implementing at least one of a plurality of sets of mitigating steps comprises adjusting at least one of an air intake door position, an engine cooling fan speed, a grill shutter position, a blower speed, and a compressor rpm.

10. The method of claim 9 wherein adjusting the engine cooling fan speed comprises operating the engine cooling fan speed at 100% capacity or increased speed.

11. The method of claim 9 wherein adjusting the grill shutter position comprises adjusting the grill shutter position to 100% open position or increased percentage.

12. The method of claim 8 wherein the step of implementing at least one of a plurality of sets of mitigating steps comprises terminating operation of the compressor.

13. The method of claim 8 wherein continuing operation of the compressor if the operating temperature is below the at least one of a plurality of predetermined threshold temperatures comprises enabling head pressure control of the compressor.

14. A compressor control method for prolonging operating time of a vehicle air conditioning compressor, comprising:

monitoring an operating temperature of an insulated gate bipolar transistor in the compressor;

comparing the operating temperature to at least one of a first predetermined threshold temperature, a second predetermined threshold temperature, a third predetermined threshold temperature and a predetermined termination threshold temperature, said first, second, third, and termination threshold temperatures sequentially increasing in magnitude;

continuing operation of the compressor if the operating temperature is below the first predetermined threshold temperature;

disabling head pressure control of the compressor if the operating temperature is above at least one of the first predetermined threshold temperature, the second predetermined threshold temperature, and the third predetermined threshold temperature, respectively; and terminating operation of the compressor if the operating temperature is above the predetermined termination threshold temperature.

15. The method of claim 14 wherein the step of implementing at least one of a plurality of sets of mitigating steps comprises adjusting at least one of an air intake door position, an engine cooling fan speed, a grill shutter position, a blower speed, and a compressor rpm.

16. The method of claim 15 wherein adjusting the engine cooling fan speed comprises operating the engine cooling fan speed at 100% capacity or increased speed.

17. The method of claim 15 wherein adjusting the grill shutter position comprises adjusting the grill shutter position to 100% open position or increased percentage.

* * * * *